US006137955A

United States Patent [19]

Krell et al.

[11] Patent Number: 6,137,955

[45] Date of Patent: Oct. 24, 2000

[54] ELECTRIC WATER HEATER WITH IMPROVED HEATING ELEMENT

[75] Inventors: Anthony Krell, Jonesborough; Timothy J. Shellenberger, Johnson City, both of Tenn.

[73] Assignee: American Water Heater Company, Johnson City, Tenn.

[21] Appl. No.: 09/090,513

[22] Filed: Jun. 4, 1998

[51] Int. Cl.[7] ..... F24H 1/20

[52] U.S. Cl. ..... 392/454; 392/449; 392/455; 392/498

[58] Field of Search ..... 392/454, 455, 392/449, 451, 497, 498, 500, 501

[56] References Cited

U.S. PATENT DOCUMENTS

| | | | |
|---|---|---|---|
| 3,781,839 | 12/1973 | Clifford . | |
| 3,909,588 | 9/1975 | Walker et al. . | |
| 3,952,182 | 4/1976 | Flanders . | |
| 4,401,261 | 8/1983 | Brown . | |
| 4,426,993 | 1/1984 | Hoyme . | |
| 4,535,931 | 8/1985 | Bartok et al. . | |
| 4,638,147 | 1/1987 | Dytch et al. . | |
| 4,672,919 | 6/1987 | Staats . | |
| 4,757,802 | 7/1988 | Guzorek . | |
| 4,848,616 | 7/1989 | Nozaki | 392/457 |
| 4,906,178 | 3/1990 | Goldstein et al. . | |
| 4,981,262 | 1/1991 | Jackson . | |
| 5,012,793 | 5/1991 | Steven . | |
| 5,163,119 | 11/1992 | Windon | 392/449 |
| 5,255,665 | 10/1993 | Windon . | |
| 5,504,306 | 4/1996 | Russell et al. . | |
| 5,586,214 | 12/1996 | Eckman | 392/503 |
| 5,692,096 | 11/1997 | Massey et al. . | |
| 5,706,390 | 1/1998 | O'Neil . | |
| 5,774,627 | 6/1998 | Jackson | 392/497 |
| 5,808,277 | 9/1998 | Dosani et al. | 219/481 |
| 5,949,960 | 9/1999 | Hall . | |

*Primary Examiner*—Teresa Walberg
*Assistant Examiner*—Thor Campbell
*Attorney, Agent, or Firm*—Schnader Harrison Segal & Lewis

[57] ABSTRACT

A water heater heating element including a base member adapted to extend through and sealingly engage a wall of a water heater tank, the base member having a recess; a thermistor positioned in the recess; members connected to the thermistor and extending outwardly of the base member to transmit temperature information; a sheathing sealed to and extending outwardly from the base member; a heating coil positioned within the sheathing; cold pins connected to opposed ends of the heating coil and to the base member, the cold pins being sufficiently long that heat generated by the heating coil is not detected by the thermistor; and members connected to the cold pins and extending outwardly of the base member to transmit power to the heating coil.

23 Claims, 5 Drawing Sheets

ELECTRIC WATER HEATER WITH IMPROVED HEATING ELEMENT

FIELD OF THE INVENTION

This invention relates to an electric water heater, particularly to an electric water heater having a heating element and an electronic control system that greatly improves manufacturing costs, reduces warranty expenses and operating efficiencies.

BACKGROUND OF THE INVENTION

Typical electric water heaters are constructed with one or two electric-powered heating elements to heat water in the water tank, depending on the size and utilization of the water heater. Each element utilizes an electromechanical thermostat mounted onto the side of the tank at the point where the screw cap of the element connects to the side of the water tank. There are a number of disadvantages associated with such constructions.

Current electromechanical thermostats use bimetal technology for actuation of a set of contacts that either energize or deenergize the heating element. Such bimetal technology is comparatively imprecise and the response time to temperature changes in the water tank are relatively slow, thereby reducing water heater efficiency.

Another significant problem with present construction is the difficulty of protecting against "dry fired" elements. "Dry fire" occurs when power is applied to a heating element without water surrounding the element. Such dry firing rapidly causes damage to the heating element, thereby sharply reducing its useful life span. In most instances, dry firing can cause immediate failure of the element.

Current electromechanical thermostats also utilize a comparatively large and bulky thermostat bracket and occupy a comparatively large amount of surface area on the side of the water tank. This reduces energy efficiency since polyurethane foam insulation that surrounds the remainder of the tank is not used in this space. This occurs because the chemicals that form the polyurethane foam can interfere with the electromechanical thermostat controls during assembly and field service. Current methods for preventing such interference include foaming aprons, fiberglass batts or EPS foam dams, all of which have lower thermal efficiency (K-factors) than the polyurethane foam surrounding the remainder of the tank.

All of the above constructions result in a large number of manufacturing parts and steps, all of which add to the final cost of the product.

OBJECTS OF THE INVENTION

It is an object of the invention to provide a water heater that increases energy efficiency.

It is another object of the invention to provide a water heater that eliminates comparatively large electromechanical thermostats and reduces the number of component parts required to produce a water heater.

Other objects and advantages of the invention will become apparent to those skilled in the art from the drawings, the detailed description of the invention and the appended claims.

SUMMARY OF THE INVENTION

In one aspect, the invention is a heating element including a base member adapted to extend through and sealingly engage the side wall of a water heater tank. The base member has a recess to receive a thermistor. Conductive members are connected to the thermistor and extend outwardly from the base member to transmit temperature information to a controller. A resistance heater sheathing is sealed to and extends outwardly from the base member and has a heating coil positioned interiorly thereof. Cold pins connect to opposed ends of the heating coil and to the base member, the cold pins being sufficiently long that heat generated by the heating coil is not substantially detected by the thermistor. Conductive members connect to the cold pins and extend outwardly from the base member to transmit power to the heating coil.

In another aspect of the invention, there is a water heater that includes a water container and a heating element located to heat water in the water container, the heating element including a base member adapted to extend through and sealingly engage the wall of a water heater tank, the base member having a recess. A thermistor is positioned in the recess and has conductive members that extend outwardly from the base member to transmit temperature information. A resistance heater sheathing is sealed to and extends outwardly from the base member. A heating coil is positioned within the sheathing and has cold pins connected to opposed ends of the heating coil and to the base member. The cold pins are sufficiently long that heat generated by the heating coil is not substantially detected by the thermistor. Conductive members connect to the cold pins and extend outwardly from the base member to transmit power to the heating coil. A controller connects to the heating element and is capable of comparing temperature information received from the thermistor with a predetermined temperature and energizing the heating element based on the comparison.

DETAILED DESCRIPTION OF THE INVENTION

Figure 2:
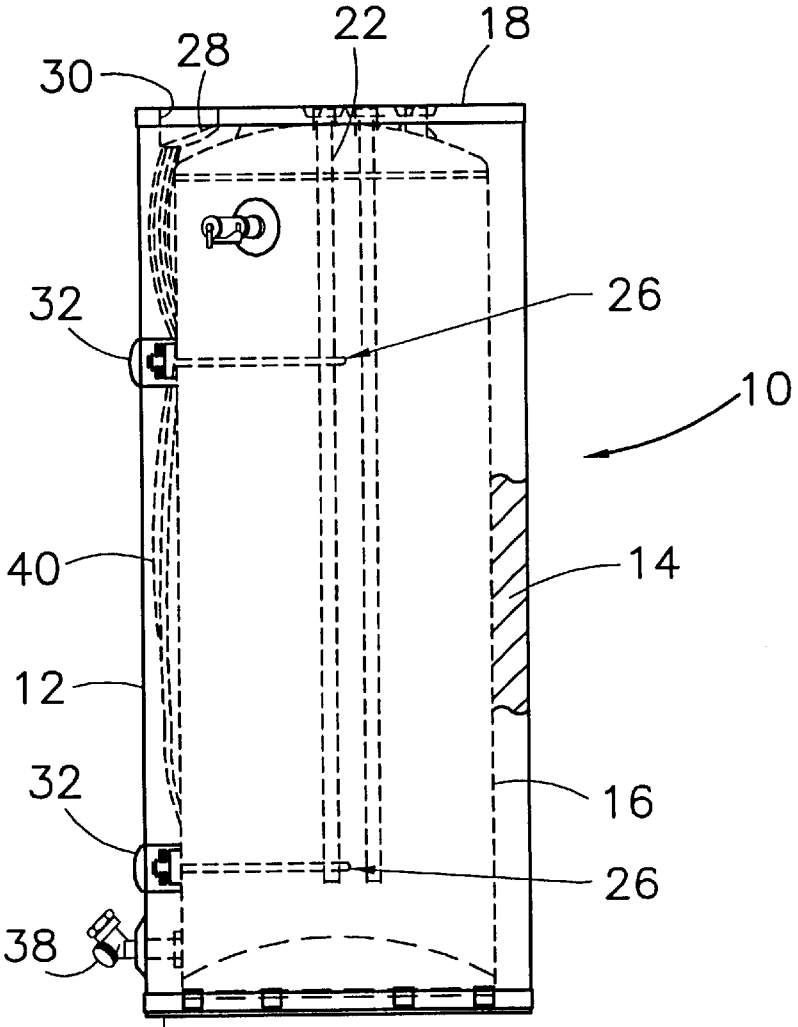
FIG. 2 shows a schematic side elevational view, taken partly in section, of the water heater of FIG. 1 wherein dashed lines show interior portions of the water heater.

It will be appreciated that the following description is intended to refer to the specific embodiments of the invention selected for illustration in the drawings and is not intended to define or limit the invention, other than in the appended claims.

Figure 1:
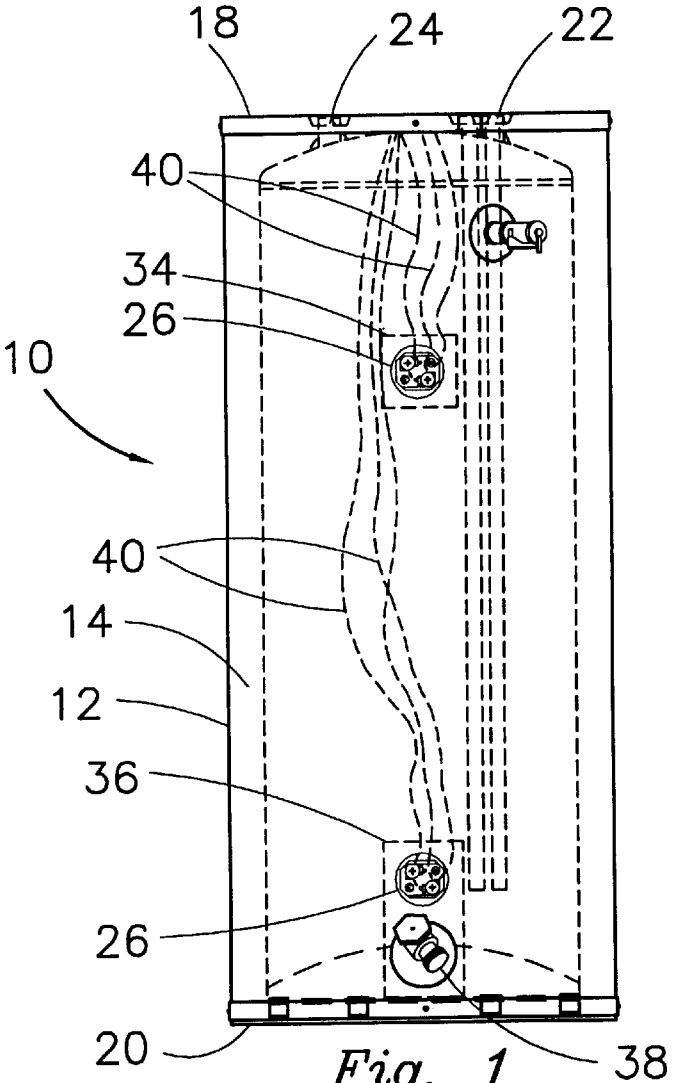
FIG. 1 shows a schematic front elevational view of a water heater in accordance with aspects of the invention wherein dashed lines show interior portions of the water heater.
Figure 4:
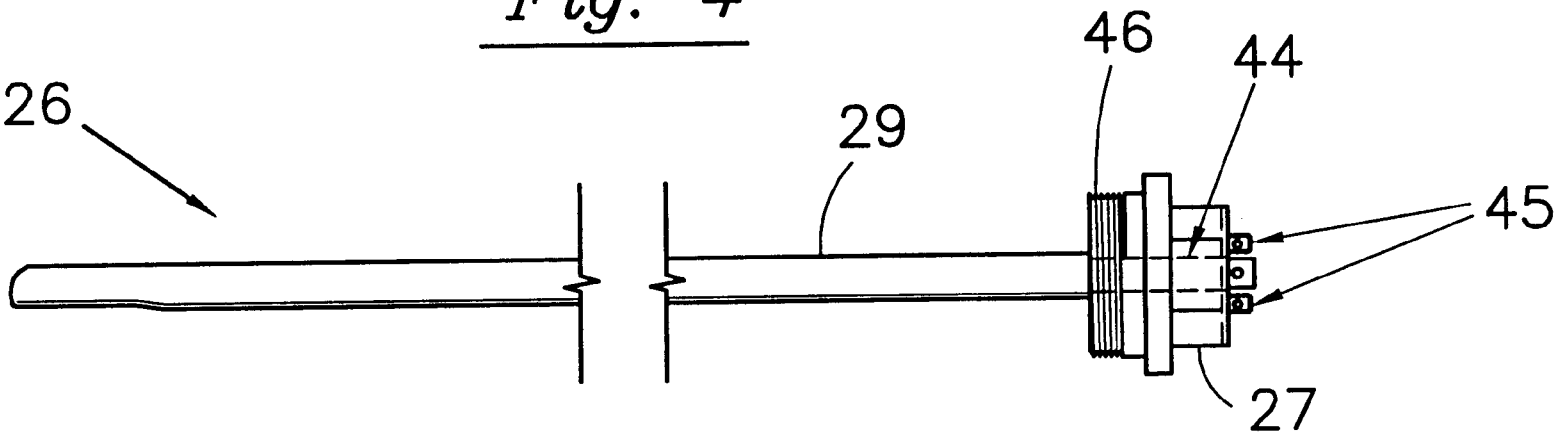
FIG. 4 shows a side view of the heating element shown in FIG. 3 wherein dashed lines show interior portions of the base of the heating element.
Figure 3:
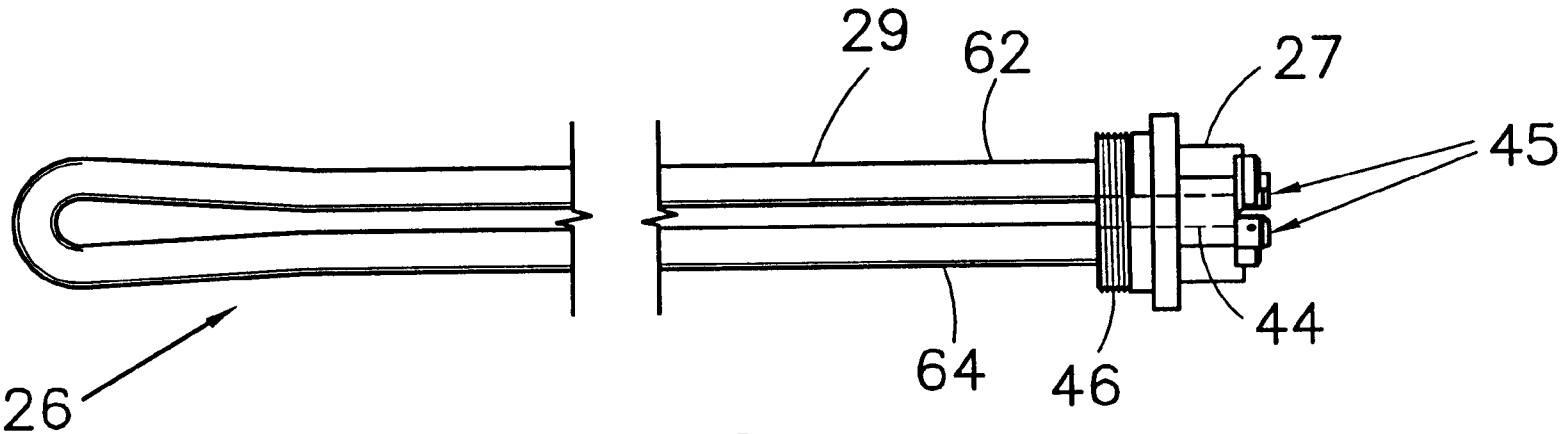
FIG. 3 shows a front elevational view of a heating element utilized in accordance with aspects of the invention.
Figure 5:
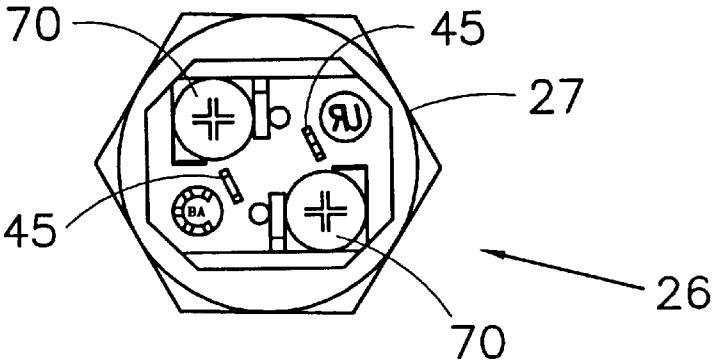
FIG. 5 shows an end view of the heating element shown in FIG. 3 wherein dashed lines show interior portions of the base of the heating element.
Figure 6:
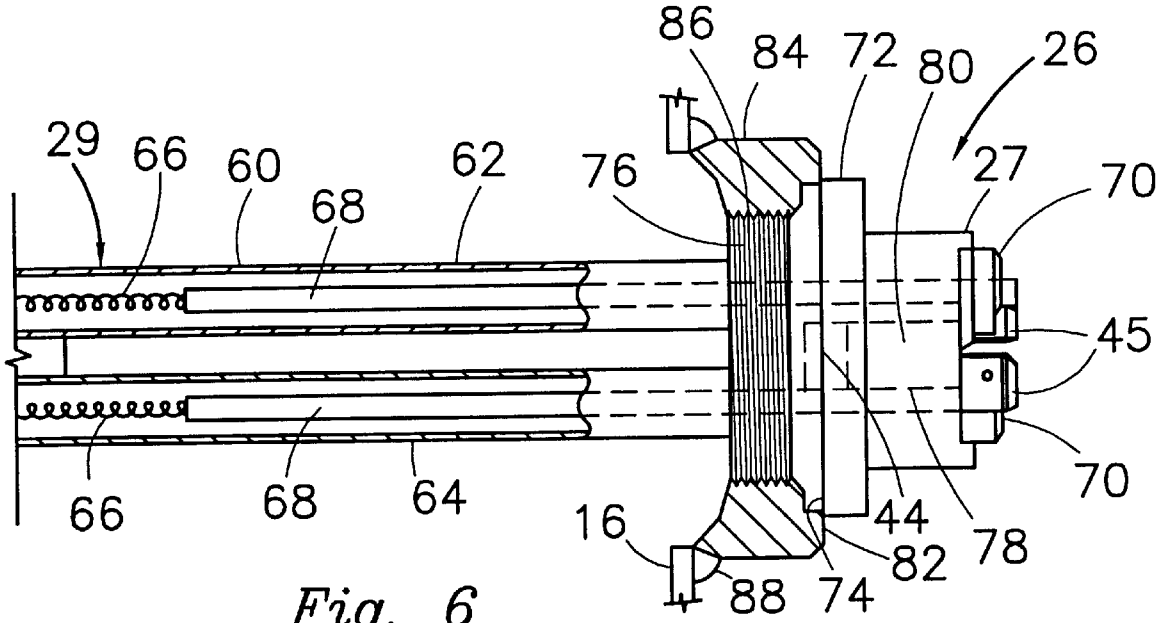
FIG. 6 shows a partial sectional view of the heating element shown in FIG. 3 mounted to a water tank spud wherein dashed lines show interior portions of the base of the heating element.

Turning now to the drawings in general and FIGS. 1–2 in particular, the number "10" designates an electric water heater of the invention. Water heater 10 includes an outer jacket 12 which surrounds foam insulation 14. Foam insulation 14 surrounds water tank 16. A top pan 18 caps jacket 12 on its upper end and bottom pan 20 caps jacket 12 on its lower end. An inlet 22 in the upper portion of tank 16 provides for cold water to enter the tank. Similarly, outlet 24 allows for hot water to exit through the upper portion of tank 16.

A pair of heating elements 26 are mounted to the side of tank 16. Elements 26 are electrically connected to an electronic controller 28 located in a recessed portion 30 of top pan 18. Elements 26 are mounted to the side wall of tank 16 and are covered by plastic caps 32 which snap into position through openings in jacket 12. An upper foam dam 34 surrounds upper element 26 and extends between tank 16 and jacket 12. Similarly, lower foam dam 36 surrounds element 26 and spigot 38. Foam dam 36 also extends between jacket 12 and tank 16.

As shown in FIGS. 3–6, each heating element 26 includes a base 27, a resistance heater 29, a thermistor sensor 44 and a pair of thermistor connectors 45. The thermistor 44 is positioned in base 27 between opposing legs of the resistance heater 29.

The resistance heater 29 includes an outer sheath 60 which is formed in a substantially "U" shape having a pair of legs 62 and 64 that sealingly connect to base 27. Interiorly of resistance heater 29 is a heating coil 66. The heating coil 66 connects on each of its opposed ends to cold pins 68. Cold pins 68 are electrically conductive but do not generate heat when current is applied to element 26. Each cold pin 68 is about 2.5 inches in length for an element 26 having a resistance heater 29 about 13.25 inches in length. This compares to a typical length of 0.8 inches. The cold pins 68 connect to screws 70 that connect to wires 40.

Base 27 includes a flange 72 that extends radially outwardly. Inner surface 74 of flange 72 contacts an outer edge 82 of spud 84 into which base 27 is mounted. Spud 84 is mounted to water tank 16 by weld 88. Threads 76 sealingly engage a corresponding set of threads 86 in spud 84 to seal base 27 to the side of water tank 16.

Base 27 also includes a recess 78 which contains thermistor sensor 44. Thermistor sensor 44 is embedded in a heat sink compound 80 that seals the thermistor sensor 44 within recess 78. Thermistor sensor 44 lies substantially along a central axis that extends through base 27 and recess 78.

As shown in FIGS. 1 and 2, electronic controller 28 connects to elements 26 by way of wires 40. Wires 40 extend between electronic controller 28 and elements 26 through the space between jacket 12 and tank 16. That space is otherwise filled with insulation 14. It is possible for wires 40 to be located such that foam-forming liquids form directly around wires 40 during the foaming process. Also, wires 40 can be located within a passageway created within the foam, if desired, such as with tubes, pipes and the like. Electronic controller 28 is a user interface and includes a water temperature adjustment dial which can be rotated to select a variety of water temperatures at which the water within tank 16 will be maintained.

Figure 7:
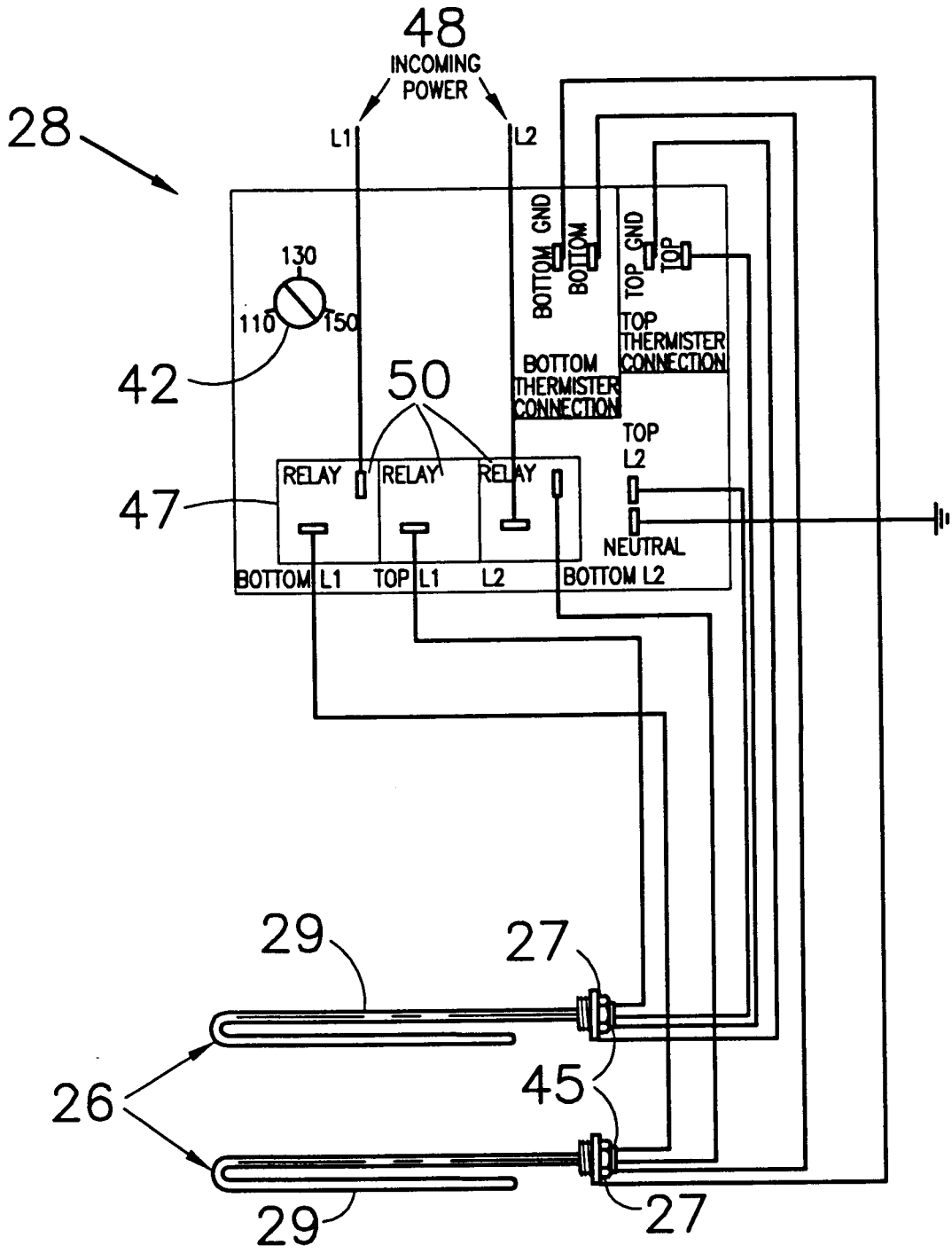
FIG. 7 discloses a circuit diagram of the control system of a water heater in accordance with aspects of the invention.
Figure 8:
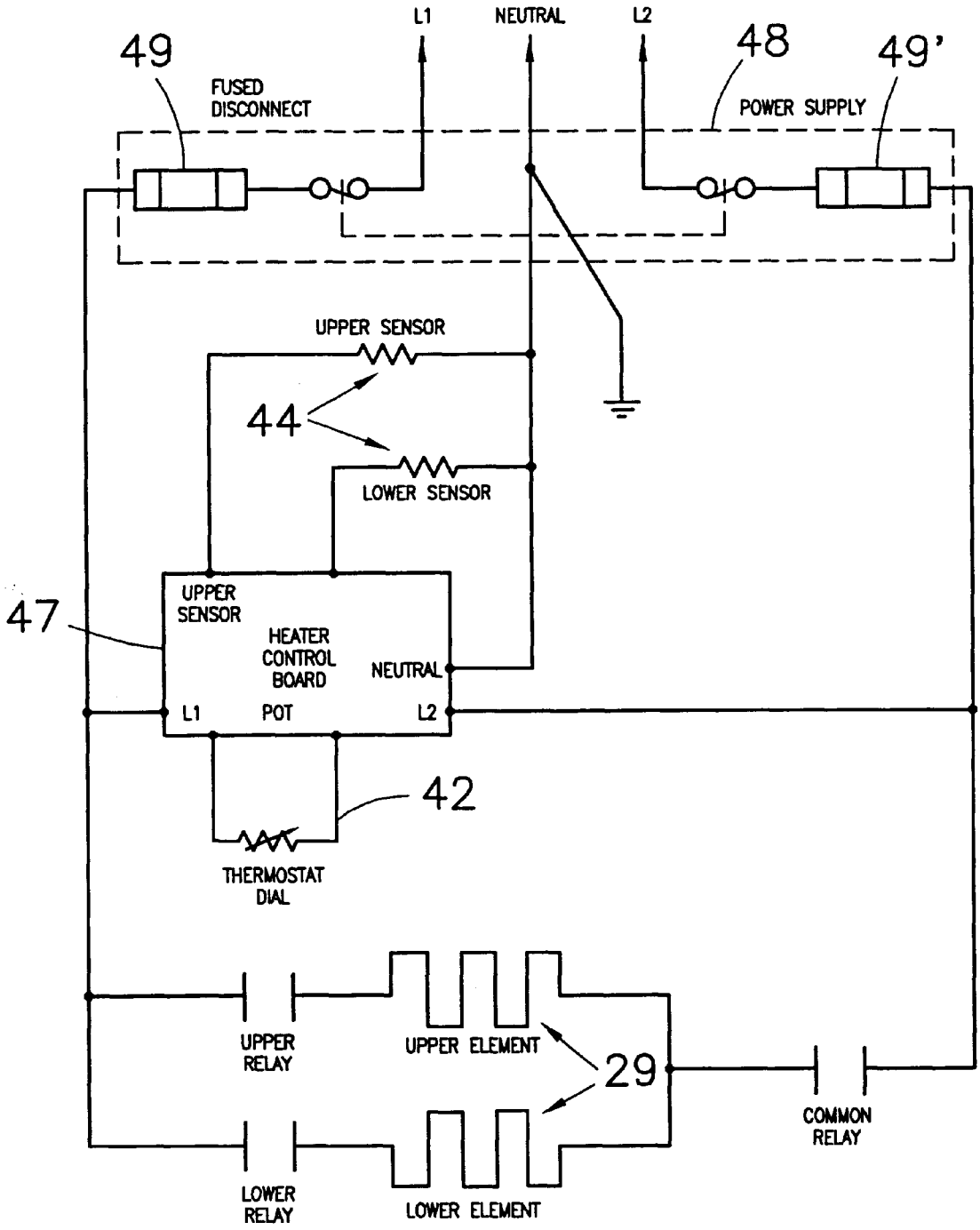
FIG. 8 shows a ladder diagram of the control system of a water heater in accordance with aspects of the invention.

The specifics of the connections and operations of electronic controller 28 and heating elements 26 shown in FIGS. 7 and 8. Thermistor 44 is connected in a conventional manner through thermistor connectors 45 to electronic controller 28. Resistance heater 29 is also connected to heater control board 47 via relays 50 on heater control board 47 in a similar manner. Electrical power is supplied to the system through power supply 48, which include fuses 49 and 49' for deenergizing the system in the event of an amperage surge.

Heater control board 47 preferably incorporates electronic control circuitry for controlling operation of the water heater, as described in more detail below. Such control circuitry may incorporate a number of electronic components, known to those of ordinary skill in the art, such as solid state transistors and accompanying biasing components, or one or more equivalent, programmable logic chips. The electronic control circuitry may also incorporate a programmable read only memory (PROM), random access memory (RAM) and a microprocessor.

The arrangement and/or programming of these components may take any number of forms well known to those of ordinary skill in the art to accomplish operation of the water heater as described below. For example, specific programming of the type described herein may be obtained from Therm-O-Disc, Inc. and United Technologies Electronic Controls.

When there is a call for hot water, hot water exits through outlet 24 and cold water is introduced through inlet 22. Thermistor sensors 44 detect the temperature of water within tank 16 by way of their being embedded in bases 27 at positions interior of the water tank side wall. The temperatures of bases 27 reflect the temperature of water in tank 16. Thermistors 44 then send temperature information, typically in the form of an electrical signal, to controller 28. Controller 28 is programmed with predetermined set point temperatures to determine the temperature at which controller 28 energizes element 26. The predetermined set point can be made to be variable if desired. When the temperature of the water within tank 16 decreases to that predetermined set point, controller 28 detects such temperature information received from thermistor sensor 44 and energizes element 26. Element 26 continues in the energized state to heat the water until temperature information received from sensor 44 indicates that the water temperature has reached a second predetermined set point.

The second predetermined set point is set by the adjustment dial and is variable. When controller 28 detects that the second predetermined set point has been reached, controller 28 deenergizes element 26. The second predetermined set point typically has five variable settings for deenergizing elements 26. Such selectable settings preferably between 90°–180° F. The differential for energizing the elements can vary depending on the task to be performed.

Controller 28 also contains a lock-out set point which is preferably less than about 210° F. The control lock-out prevents elements 26 from energizing when the water temperature reaches an abnormal predetermined set point and the controller 28 will not permit energizing of elements 26 until controller 28 is reset by removing power and then subsequently reapplying power. This can be accomplished automatically by controller 28, thereby reducing and possibly eliminating the need for mechanical reset control. Such a reset could be performed by a reset user interface on controller 28. The sensing capabilities of sensors 44 are such that elements 26 can be energized and deenergized after only approximately 1.5 gallons of water have been drawn from tank 16. This compares to about 3.0 gallons of water removal in prior art constructions.

One particular sequence of operational steps to achieve operation of the water heater in this matter is described below. When the water heater control system is first started, the control electronic circuitry of heater control board 47 records the initial temperature at bottom element 26 and then turns on the bottom element 26 for ten seconds and then off for two minutes. Heater control board 47 then records the file temperature of the bottom element 26 as measured through thermistor 44 and calculates the difference between the final temperature and initial temperature.

If the difference between these temperatures is greater than five degrees, then heater control board 47 turns off both elements 26 through relays 50. Heater control board 47 then checks to see if system power has been turned off or reset through incoming power supply 48. Once the system has been reset, heater control board 47 then begins this process from start.

If, however, the temperature differential is less than five degrees, then heater control board 47 energizes bottom element 26 to heat the water in tank 16 until it reaches the temperature set on the temperature adjust dial.

If the temperature of the temperature adjust dial is less than 110° F., then the top element 26 remains off. Otherwise, heater control board 47 checks the temperature at thermistor 44 in upper element 26. If the temperature of thermistor 44 in upper element 26 is equal to the temperature of the dial minus 5° F., then heater control board 47 does not energize upper element 26 until the temperature at thermistor 44 in upper element 26 is less than the turn on temperature (which is typically the temperature set on the temperature adjust dial minus some increment such as 5√) minus 5° F. Heater control board 47 then energizes top element 26.

Heating of the water in tank 16 then continues in a conventional manner until the turn off temperature of the temperature adjust dial is achieved.

By energizing upper and lower elements 26 in the manner described above, the significant advantages of the invention can be achieved. For example, energizing the element briefly (e.g., about 5"10 seconds) and detecting temperature with a thermistor allows heater control board 47 to prevent elements 26 from being energized for long periods of time in a "dry fire" condition, thereby avoiding substantial degradation of the elements and significantly extending their life. Thus, the terms "substantially no degradation" refers to little or no element degradation that occurs for an element energization period of about 5 seconds and up to about 10 seconds. Energizing the element for longer than about 10 seconds can result in substantial degradation under any fire conditions.

Use of thermistor 44 allows for a much more accurate and responsive detection of temperature than the use of more conventional temperature-sensing technology, such as bimetallic strip. This allows the significant temperature changes which occur in a short period of time under a dry fire condition to be detected with only a short (e.g., 10 seconds) energizing of the heating element 26. In this way, a dry fire condition can be detected virtually immediately to prevent overheating of the element, which significantly reduces its useful life.

We have discovered that thermistor 44, when embedded in heat sink compound 80 within recess 78, provides for the highly accurate temperature readings discussed above. We have also discovered that the cold pins previously used are so short that they permit heat generated from heating coil 66 to influence the readings from the bimetallic strips. This is because local heat radiating from heating coil 66 artificially raises the temperature of base 27, thereby providing for inaccurate results. Lengthening cold pins 68 from the standard 0.8 inches to at least about 2 inches and, more preferably, to about 2.5 inches, substantially eliminates the localized effect of heat emanating from heating coil 66. In other words, cold pins 68 should be 2–3 times the length of conventional cold pins. Cold pins 68 are preferably made from nickel plated cold rolled steel.

In its most preferred form, heating element 26 has a voltage range of about 110 to about 480 volts and a wattage range of about 1,000 to 6,000. Thermistor 44 may preferably be obtained from Therm-o-Disc, Inc. and heat sink compound 80 may be obtained from Locktite, Inc., especially Locktite 383. Similarly, sheathing 60 is preferably made from copper, although other appropriate materials may be used. Base 27 is preferably made from a corrosion resistant steel although other materials may be used so long as they are corrosion resistant and heat transmissive.

Also, use of thermistors 44 eliminates conventional electromechanical thermostats and their associated foaming aprons, fiberglass batts and the like. Small EPS foam darns 34 surround bases 27 and permit foam insulation to cover more surface area of the tank. As an example, the surface area on the side wall of the water tank now typically not covered by foam insulation for each heating element is about 289 square inches. This surface can be reduced in the invention to about 84 square inches or less. This represents a reduction of about 70%. The small foam dams are preferably "donut" shaped and are sized and shaped to closely fit around and substantially up against base 27.

The improvements described above result in a highly energy efficient water heater. The result is that the thickness of the foam insulation positioned between tank 16 and jacket 12 can be reduced by up to about 50%. In other words, a 2" foaming cavity can be reduced to a 1" cavity, and still retain the same energy input and standby losses.

Although this invention has been described in connection with specific forms thereof, it will be appreciated that a wide variety of equivalents may be substituted for the specific elements described herein without departing from the spirit of the scope of this invention as described in the appended claims. For example, water tank 16 may be made of a number of sizes and shapes and may be made from a wide variety of materials such as metals and/or plastics. Foam insulation 14 may similarly be made from any number of high energy efficient foam insulations well known in the art.

The bottom of the water tank 16 may have various shapes, either with lower flanges as shown or as a flat construction. Other modifications may be made, including use of foam insulation between the bottom of tank 16 and bottom pan 20. Also, outer jacket 12 may be made from any number of materials such as rolled metals, preferably steel, or extruded vinyl materials and the like. Also, top pan 18 and bottom pan 20 may be deep-drawn, stamped or the like, or be made from metal, plastic or other suitable materials.

An alternative set of operational steps in accordance with the invention is also possible. In this alternative, during control power up of the water heater, heater control board 47 checks to see if there is a need for heating of the water at lower element 26 by measuring the temperature at thermistor 44 and comparing the measured temperature with that of the temperature adjust dial. If such a demand exists, heater control board 47 energizes lower element 26 and continuously checks to see if the water heating demand is satisfied. Once this heating demand is satisfied, heater control board 47 then repeats this process for the upper element 26.

What is claimed is:

1. A water heater heating element comprising:

a heat transmissive base member adapted to extend through and sealingly engage a wall of a water heater tank, said base member having a recess;

a thermistor positioned in said recess;

members electrically connected to said thermistor and extending outwardly of said base member to transmit temperature information to a controller;

a sheathing sealed to and extending outwardly from said base member and into said water heater tank;

a heating coil positioned within said sheathing;

cold pins mounted to said base member and electrically connected to opposed ends of said heating coil, said cold pins being sufficiently long that heat generated by said heating coil is not substantially detected by said thermistor; and members extending outwardly of said base member and electrically connected to said cold pins and a power source to transmit power to said heating coil.

2. The heating element defined in claim 1 further comprising threads formed on said base member to sealingly engage threads formed on said wall.

3. The heating element defined in claim 2 wherein said threads formed on said wall are formed in a spud sealingly mounted on said wall.

4. The heating element defined in claim 1 wherein said base member further comprises a radially extending flange adapted to engage an outer surface of said wall.

5. The heating element defined in claim 1 wherein said cold pins are at least about 2 inches long.

6. The heating element defined in claim 1 wherein said cold pins are about 2.5 inches long.

7. The heating element defined in claim 1 wherein said cold pins are made from nickel plated cold rolled steel.

8. The heating element defined in claim 1 further comprising a heat sink compound surrounding said thermistor.

9. The heating element defined in claim 8 wherein said heat sink compound seals said thermistor in said recess.

10. The heating element defined in claim 1 wherein said thermistor is soldered to said members connected to said thermistor.

11. The heating element defined in claim 1 wherein said base member is substantially round and has a central axis running therethrough and wherein said thermistor is located substantially at said central axis.

12. An electric water heater comprising:

1) a water container;

2) a heating element located to heat water in said water container, said heating element comprising:

a heat transmissive base member adapted to extend through and sealingly engage a wall of a water heater tank, said base member having a recess;

a thermistor positioned in said recess;

members electrically connected to said thermistor and extending outwardly of said base member to transmit temperature information;

a sheathing sealed to and extending outwardly from said base member and into said water container;

a heating coil positioned within said sheathing;

cold pins mounted to said base member and electrically connected to opposed ends of said heating coil, said cold pins being sufficiently long that heat generated by said heating coil is not substantially detected by said thermistor;

members extending outwardly of said base member and electrically connected to said cold pins and a power source to transmit power to said heating coil; and 3) a controller electrically connected to said heating element and, separately, to said members connected to said thermistor, said controller being capable of comparing temperature information received from said thermistor with a predetermined temperature and energizing said heating element based on said comparison.

13. The water heater defined in claim 12 further comprising:

a second heating element located above said heating element and positioned to heat said water, said second heating element comprising:

a heat transmissive base member adapted to extend through and sealingly engage a wall of a water heater tank, said base member having a recess;

a thermistor positioned in said recess;

members electrically connected to said thermistor and extending outwardly of said base member to transmit temperature information to said controller;

a sheathing sealed to and extending outwardly from said base member and into said water container;

a heating coil positioned within said sheathing;

cold pins mounted to said base member and electrically connected to opposed ends of said heating coil, said cold pins being sufficiently long that heat generated by said heating coil is not substantially detected by said thermistor; and members extending outwardly of said base member and electrically connected to said cold pins and said power source to transmit power to said heating coil, said second heating element being connected to said controller.

14. The water heater defined in claim 12 wherein said predetermined temperature is variable.

15. The water heater defined in claim 12 wherein said controller is capable of comparing temperature information received from said thermistor with a second predetermined temperature and deenergizing said element based on the result thereof.

16. The water heater defined in claim 15 wherein said second predetermined temperature is variable.

17. The water heater defined in claim 12 wherein said controller is capable of comparing temperature information received from said sensor with a third predetermined temperature and engaging a controller lockout based on the result thereof.

18. The water heater defined in claim 17 wherein said controller lockout is disengaged by interrupting and then restoring power to said controller.

19. The water heater defined in claim 12 further comprising a jacket surrounding said water container and foam insulation positioned between said jacket and said water container.

20. The water heater defined in claim 19 further comprising a foam dam surrounding said base member and positioned between said jacket and said water container.

21. The water heater defined in claim 20 wherein said foam dam has an open interior surface sized and shaped to fit adjacent said base member.

22. An electric water heater comprising:

1) a water tank;

2) a heating element located to heat water in said water tank, said heating element comprising:

a heat transmissive base member adapted to extend through and sealingly engage a wall of a water heater tank, said base member having a recess;

a thermistor positioned in said recess;

members electrically connected to said thermistor and extending outwardly of said base member to transmit temperature information;

a sheathing sealed to and extending outwardly from said base member and into said water tank;

a heating coil positioned within said sheathing;

cold pins mounted to said base member and electrically connected to opposed ends of said heating coil, said cold pins being sufficiently long that heat generated by said heating coil is not substantially detected by said thermistor;

members extending outwardly of said base member and electrically connected to said cold pins and a power source to transmit power to said heating coil; and 3) a controller electrically connected to said heating element and, separately, to said members connected to said thermistor, said controller being capable of comparing temperature information received from said thermistor with a predetermined temperature and energizing said heating element when said sensed temperature is less than said predetermined temperature, and said controller being capable of comparing a plurality of sensed temperatures and deenergizing said heating element in the event that the difference between sensed temperatures over a predetermined time is greater than a predetermined temperature difference.

23. The water heater defined in claim 22 further comprising:

a second heating element located above said heating element and positioned to heat said water, said second heating element comprising:

a heat transmissive base member adapted to extend through and sealingly engage a wall of a water heater tank, said base member having a recess;

a thermistor positioned in said recess;

members electrically connected to said thermistor and extending outwardly of said base member to transmit temperature information to said controller;

a sheathing sealed to and extending outwardly from said base member and into said water tank;

a heating coil positioned within said sheathing;

cold pins mounted to said base member and electrically connected to opposed ends of said heating coil, said cold pins being sufficiently long that heat generated by said heating coil is not substantially detected by said thermistor; and members extending outwardly of said base member and electrically connected to said cold pins and said power source to transmit power to said heating coil, said second heating element being connected to said controller.

* * * * *